US006408053B1

(12) United States Patent
Lee et al.

(10) Patent No.: US 6,408,053 B1
(45) Date of Patent: Jun. 18, 2002

(54) X-RAY TUBE

(75) Inventors: Sang Gon Lee; Jun Gyo Bak, both of Taejon (KR); Manfred Bitter, Princeton, NJ (US)

(73) Assignee: Korea Basic Science Institute, Taejon (KR)

( * ) Notice: Subject to any disclaimer, the term of this patent is extended or adjusted under 35 U.S.C. 154(b) by 0 days.

(21) Appl. No.: 09/697,616

(22) Filed: Oct. 26, 2000

(30) Foreign Application Priority Data

Sep. 4, 2000 (KR) ..... 00-52081

(51) Int. Cl.[7] ..... H01J 35/06
(52) U.S. Cl. ..... 378/136; 378/119
(58) Field of Search ..... 378/119, 121, 378/123, 136, 137, 138, 143

(56) References Cited

U.S. PATENT DOCUMENTS 1,027,795 A * 5/1912 Baker ..... 378/123
1,042,109 A * 10/1912 Green ..... 378/123
3,143,679 A * 8/1964 Stansfield ..... 378/136
4,560,897 A * 12/1985 Hudgens ..... 378/136
5,142,652 A * 8/1992 Reichenberger et al. .... 378/136

* cited by examiner

*Primary Examiner*—David P. Porta
(74) *Attorney, Agent, or Firm*—Abelman, Frayne & Schwab

(57) ABSTRACT

Disclosed is an X-ray tube for generating X-rays linearly focused in a vertical or horizontal direction in accordance with the orientation of a filament used. The X-ray tube includes a linear filament arranged at a cathode included in the X-ray tube, the linear filament serving to allow an anode included in the X-ray tube to generate line-focused X-rays. The X-ray tube according to the present invention can be applied to a calibration for X-ray spectroscopes, or various applications requiring line-focused X-rays.

2 Claims, 3 Drawing Sheets

X-RAY TUBE

BACKGROUND OF THE INVENTION

1. Field of the Invention

The present invention relates to a device for generating X-rays, and more particularly to an X-ray tube for generating X-rays linearly focused in a vertical or horizontal direction in accordance with the orientation of a filament used.

2. Description of the Related Art

Conventional X-ray tubes typically use an anode made of a particular material suitable to generate desired X-rays in cooperation with a spiral filament. When a high voltage is applied to the anode made of the particular material, thermoelectrons are emitted from the filament. By virtue of the effect of those thermoelectrons, two kinds of X-rays, that is, X-rays emitted from the particular material and continuous X-rays resulting from a bremsstrahlung effect are generated. Meanwhile, it is frequently required to generate line-focused X-rays. For the generation of such line-focused X-rays, conventional X-ray tubes may utilize a very fine and sophisticated slit. In this case, however, undesirable fluorescent X-rays may be generated due to the material of the slit. Furthermore, there is a reduction in the intensity of X-rays.

SUMMARY OF THE INVENTION

Therefore, the present invention has been made in view of the above mentioned problems involved in the conventional X-ray tubes, and an object of the invention is to provide an X-ray tube which does not use a spiral filament, but uses a linear filament, thereby generating X-rays linearly focused in a vertical or horizontal direction in accordance with the orientation of the linear filaments.

Another object of the invention is to provide an X-ray tube capable of line-focused X-rays without using no fine and sophisticated slit.

In order to accomplish the above mentioned objects, the present invention provides an X-ray tube comprising: a linear filament arranged at a cathode included in the X-ray tube, the linear filament serving to allow an anode included in the X-ray tube to generate line-focused X-rays.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Figure 1:
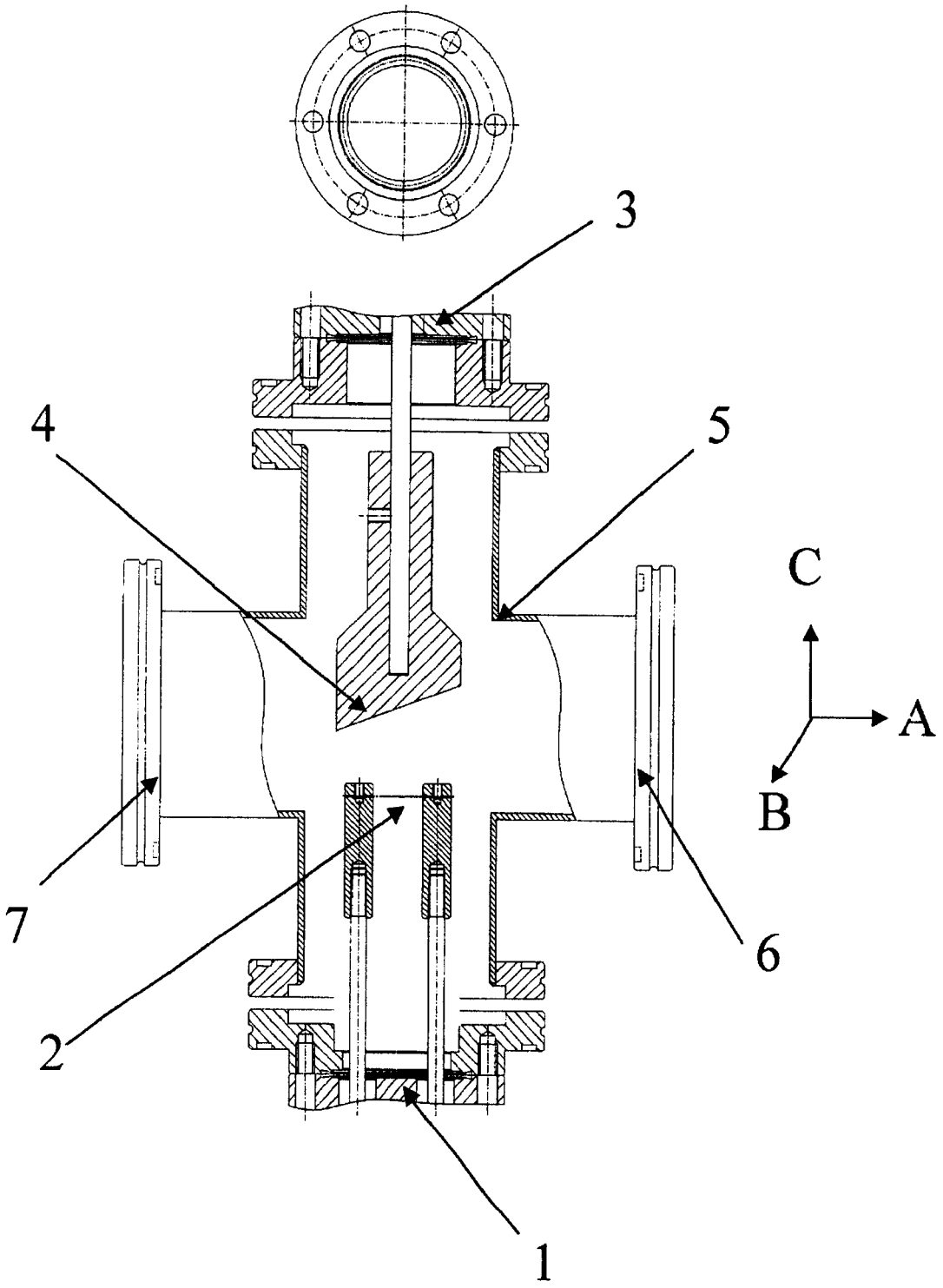
FIG. 1 is a cross-sectional view illustrating the assembled configuration of an X-ray tube according to an embodiment of the present invention.

FIG. 1 is a cross-sectional view illustrating the assembled configuration of an X-ray tube according to an embodiment of the present invention.

As shown in FIG. 1, the X-ray tube according to the illustrated embodiment of the present invention includes a vacuum container 5 having a 4-way crosses shape. A cathode 2 is received in the vacuum container 5 while being connected to a vacuum current feedthrough. The cathode 2 is mounted with a linear filament serving to generate thermoelectrons. The X-ray tube also includes an anode 4 connected to a vacuum voltage feedthrough and received in the vacuum container 5 in such a fashion that it faces the linear filament while being spaced apart from the linear filament. The anode 4 serves to generate line-focused X-rays by virtue of thermoelectrons generated from the linear filament. The X-ray tube further includes a window 6 adapted to transmit line-focused X-rays generated from the anode 4, and a vacuum pump port 7 adapted to maintain a desired vacuum in the vacuum container 5.

Preferably, the vacuum container 5, which is 4-way crosses, is of an ISO 63 standard. However, this vacuum container 5 is not limited in terms of its size and shape. As shown in FIG. 1, the cathode 2, anode 4, window 6 and vacuum pump port 7 are arranged at respective portions of the vacuum container 5 extending different directions of the 4 ways.

As described above, the cathode 2, which is arranged in the 4-way vacuum container 5, is connected to the vacuum current feedthrough and adapted to generate thermoelectrons. For the generation of such thermoelectrons, the above mentioned linear filament is provided at the cathode 2. Preferably, the linear filament is a thorium-coated tungsten wire having a diameter of 0.5 mm and a length of about 25 mm.

The anode 4, which is connected to the vacuum voltage feedthrough, is arranged opposite to the cathode 2 in the 4-way vacuum container 5 in such a fashion that it faces the cathode 2 while being spaced apart from the cathode 2. The anode 4 has an inclined end so that it generates line-focused X-rays by virtue of thermoelectrons generated from the linear filament of the cathode 2. Preferably, the anode 4 comprises a copper rod having a diameter of 40 mm at an end facing the cathode 2 while having an inclined end surface having a shape cut at an angle of about 20°. The anode 4 is configured in such a fashion that its space from the filament is adjusted. For the generation of X-rays, a high voltage of 10 kV is applied to the anode 4. In this configuration, Cu-$K_\alpha$, Cu-$K_\beta$ or bremsstrahlung X-rays are generated by virtue of thermoelectrons emitted from the linear filament.

The window 6 is made of polypropylene and adapted to transmit Cu-$K_\alpha$, Cu-$K_\beta$ or bremsstrahlung X-rays emitted from the anode 4 therethrough.

The vacuum pump port 7 is arranged opposite to the window 6 and adapted to maintain a desired vacuum in the 4-way vacuum container 5. Preferably, the vacuum container 5 is maintained at a vacuum of $10_{-5}$ Torr or less.

In accordance with the present invention, the kind of the anode 4, the level of the high voltage applied to the anode 4, the kind of the window 6, and the length and diameter of the linear filament may be optionally and variously selected.

Where the anode 4 is oriented in such a fashion that its end surface extends at an angle of 20° with respect to a direction A shown in FIG. 1 under the condition in which the linear filament extends in the direction A, X-rays generated from the anode 4 are linearly focused in a direction B when viewed from the window 6. On the other hand, where the anode 4 is oriented in such a fashion that its end surface extends at an angle of 20° with respect to the direction A under the condition in which the linear filament extends in the direction B perpendicular to the direction A, X-rays generated from the anode 4 are linearly focused in a direction C when viewed from the window 6. Such characteristics can be obtained by virtue of the use of the linear filament. Where the linear filament is used, X-rays can be generated even when the orientation of the linear filament is varied by an angle of 90°, as compared to the conventional case using a spiral filament.

Figure 2:
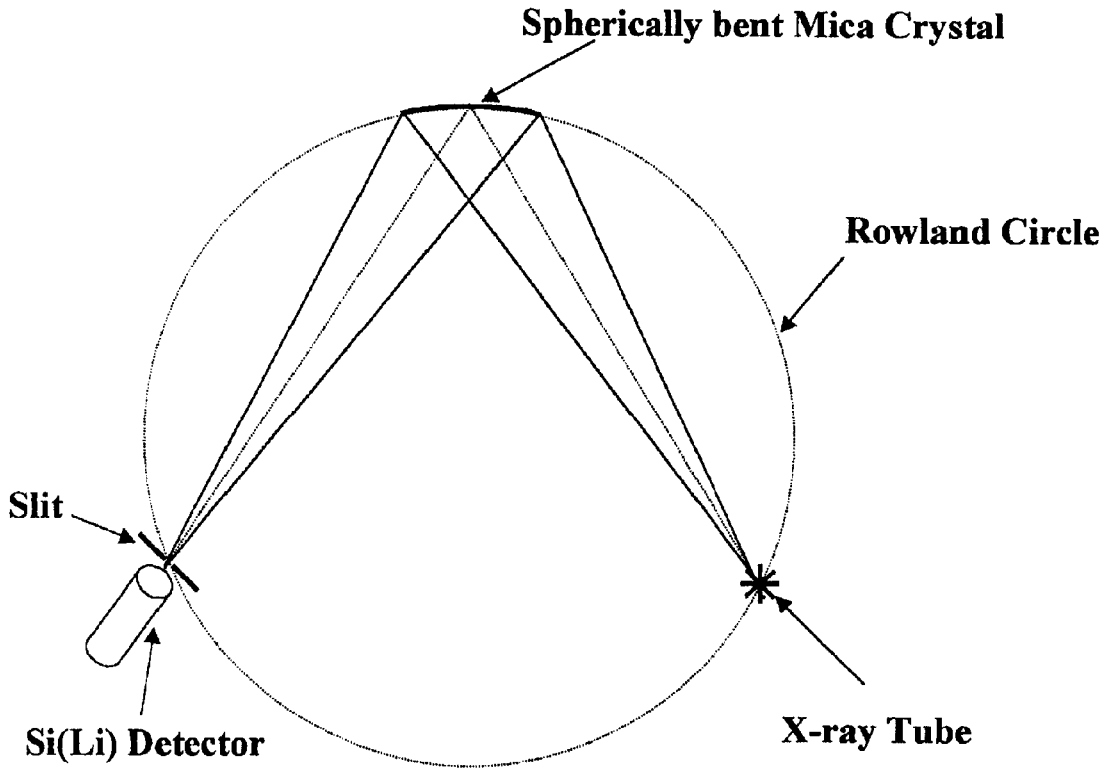
FIG. 2 is a schematic view illustrating an experimental measurement conducted for the X-ray tube of the present invention using a vacuum X-ray crystal spectroscope.

FIG. 2 is a schematic view illustrating an experimental measurement conducted for the X-ray tube of the present invention using a vacuum X-ray crystal spectroscope.

Figure 3:
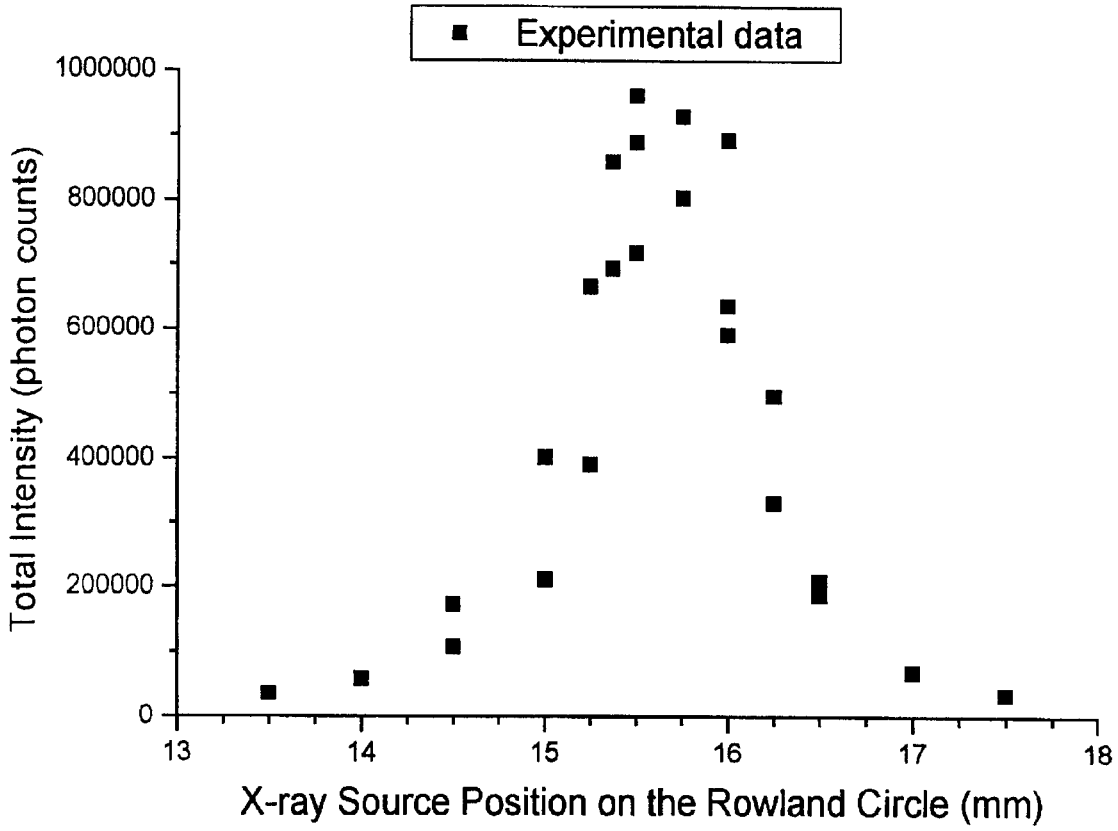
FIG. 3 is a graph depicting the degree of linear focusing obtained in the X-ray tube of the present invention under the experiment condition of FIG. 2.

FIG. 3 is a graph depicting the degree of linear focusing obtained in the X-ray tube of the present invention under the experiment condition of FIG. 2.

The degree of linear focusing depicted by the graph of FIG. 3 is that obtained in the case in which the linear filament is oriented in the direction B of FIG. 1. That is, FIG. 3 shows the results of the measurement for X-rays linearly focused in the direction C of FIG. 1. This measurement is conducted using an Si(Li) detector under the condition in which a slit having a thickness of 1 mm is arranged in front of the window. The graph of FIG. 3 shows the results of photon counts measured under the condition in which the position of the X-ray tube on a Rowland circle of FIG. 2 is gradually and finely varied in a lateral direction. Referring to FIG. 3, it can be found that the X-ray tube of the present invention exhibits superior results indicative of the line-focused degree of X-rays in the direction C.

As apparent from the above description, the X-ray tube of the present invention uses a linear filament, thereby being capable of relatively easily generating line-focused.

In accordance with the present invention, it is possible to generate line-focused X-rays without using no fine and sophisticated slit.

The X-ray tube according to the present invention can be applied to a calibration for X-ray spectroscopes, or various applications requiring line-focused X-rays.

Thus, the present invention provides an X-ray tube which uses a linear filament, thereby being capable of X-rays linearly focused in a vertical or horizontal direction in accordance with the kind and orientation of the linear filament.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An X-ray tube comprising:

a 4-way vacuum container having a cross shape;

a cathode received in the vacuum container while being connected to a vacuum current feedthrough, the cathode being provided with a linear filament serving to generate thermoelectrons;

an anode connected to a vacuum voltage feedthrough and received in the vacuum container in such a fashion that it faces the linear filament while being spaced apart from the linear filament, the anode serving to generate line-focused X-rays by virtue of thermoelectrons generated from the linear filament;

a window adapted to transmit the line-focused X-rays generated from the anode therethrough; and a vacuum pump port adapted to maintain a desired vacuum in the vacuum container.

2. The X-ray tube according to claim 1, further comprising:

a distance adjusting unit for adjusting the space between the anode and the linear filament.

* * * * *